US005455155A

United States Patent [19]

Brick et al.

[11] Patent Number: 5,455,155

[45] Date of Patent: Oct. 3, 1995

[54] PHOTOGRAPHIC ELEMENT HAVING REDUCED DYE STAIN

[75] Inventors: Mary C. Brick; Norma B. Platt, both of Webster; Paul L. Zengerle; Jeffery L. Hall, both of Rochester, all of N.Y.

[73] Assignee: Eastman Kodak Company, Rochester, N.Y.

[21] Appl. No.: 198,335

[22] Filed: Feb. 18, 1994

Related U.S. Application Data

[62] Division of Ser. No. 51,137, Apr. 22, 1993, abandoned.

[51] Int. Cl.[6] ..... G03C 1/43; G03C 7/392

[52] U.S. Cl. ..... 430/566; 430/214; 430/505; 430/551; 430/631

[58] Field of Search ..... 430/214, 551, 430/566, 505, 631, 449, 484, 493; 23/295; 252/363.5, 310, 314

[56] References Cited

U.S. PATENT DOCUMENTS

| | | | |
|---|---|---|---|
| 2,983,606 | 5/1961 | Rogers | 430/215 |
| 3,008,657 | 11/1961 | Szegvari | 241/170 |
| 3,075,710 | 1/1963 | Feld et al. | 241/16 |
| 3,149,789 | 9/1964 | Szegvari | 241/27 |
| 4,006,025 | 2/1977 | Swank et al. | 96/129 |
| 4,205,987 | 6/1980 | Erikson et al. | 430/216 |
| 4,362,806 | 12/1982 | Whitmore | 430/202 |
| 4,447,523 | 5/1984 | Ross et al. | 430/505 |
| 4,525,451 | 6/1985 | Ohki et al. | 430/551 |
| 4,530,889 | 7/1985 | Ohki et al. | 430/551 |
| 4,542,092 | 9/1985 | Toya et al. | 430/551 |
| 4,575,481 | 3/1986 | Takahashi et al. | 430/214 |
| 4,584,263 | 4/1986 | Takahashi et al. | 430/533 |
| 4,766,058 | 8/1988 | Sampei et al. | 430/496 |
| 4,871,658 | 10/1989 | Sakamoto et al. | 430/551 |
| 4,923,787 | 5/1990 | Harder | 430/489 |
| 4,927,744 | 5/1990 | Henzel et al. | 430/566 |
| 4,940,654 | 7/1990 | Diehl et al. | 430/522 |
| 4,952,474 | 8/1990 | Tsukahara et al. | 430/138 |
| 4,994,351 | 2/1991 | Haga et al. | 430/379 |
| 5,051,342 | 9/1991 | Shiba et al. | 430/383 |
| 5,300,394 | 4/1994 | Miller et al. | 430/551 |

FOREIGN PATENT DOCUMENTS

| | | | |
|---|---|---|---|
| 320821 | 12/1988 | European Pat. Off. | G03C 7/26 |
| 59-222836 | 5/1983 | Japan | G03C 7/26 |
| 62103634 | 10/1985 | Japan | G03C 1/06 |
| 62100750 | 10/1985 | Japan | G03C 7/26 |
| 62-205343 | 3/1986 | Japan | G03C 7/32 |
| 1144052 | 2/1987 | Japan | G03C 7/38 |
| 1570362 | 3/1977 | United Kingdom | G03C 1/02 |

OTHER PUBLICATIONS

Research Disclosure No. 17643, Dec. 1978, *Photographic Silver Halide Emulsions,* Preparations, Addenda, Processing and Systems, J. W. Carpenter, pp. 22–32.

Research Disclosure No. 18169, *A Color Diffusion Transfer Photographic Product,* May 1979, pp. 228–229.

Research Disclosure No. 34390, Nov. 1992, *Photographic Light–Sensitive Silver Halide Film Can Comprise A Transparent Magnetic Recording Layer, Usually Provided On The Backside Of The Photographic Support,* pp. 869–874.

*Primary Examiner*—Richard L. Schilling

*Attorney, Agent, or Firm*—Andrew J. Anderson

[57] ABSTRACT

Undesirable dye stain in a photographic element containing a disulfonamidophenol oxidized developer scavenger can be significantly reduced when the disulfonamidophenol scavenger is in the form of a crystalline solid particle dispersion prepared by milling crystalline solid particles of the scavenger in an aqueous medium in the presence of a dispersing agent and in the substantial absence of an organic solvent.

6 Claims, No Drawings

PHOTOGRAPHIC ELEMENT HAVING REDUCED DYE STAIN

BACKGROUND OF THE INVENTION

This application is a continuation in part of copending application Ser. No. 08/051,137 filed Apr. 22, 1993, now abandoned, the entire disclosure of which is incorporated herein by reference.

This invention relates to a method of reducing dye stain in a photographic element and to a photographic element having reduced dye stain.

It is known in the art to add scavengers for oxidized developing agents to photographic elements to allow the scavenger to interact with the oxidized developing agent and prevent unwanted reaction between oxidized developer and components of the photographic element. Included among the scavengers for oxidized developing agent known in the art are disulfonamidophenol derivatives disclosed in U.S. Pat. Nos. 4,205,987 to Erikson et al, 4,447,523 to Ross et al and 4,952,474 to Tsukahara et al. These patents disclose using these scavengers as oil-in-water dispersions which are prepared by dissolving the scavenger in a high boiling organic solvent and then dispersing the resulting solution in an aqueous gelatin medium using mechanical means to obtain fine droplets.

PROBLEM TO BE SOLVED BY THE INVENTION

It has been found that when the disulfonamidophenol scavenger is used in a multilayer color photographic element as an oil-in-water dispersion, unacceptable dye stain may occur, particularly in the low-density areas of the photographic element. The dye stain is particularly noticeable when the emulsion is spectrally sensitized to be sensitive to red light. We have discovered that the stain is reduced to an acceptable level when a disulfonamidophenol oxidized developer scavenger is incorporated in the photographic element as a dispersion of crystalline solid particles of the scavenger and the dispersion has been prepared without the use of an organic solvent.

SUMMARY OF THE INVENTION

One aspect of this invention comprises a photographic element comprising a support having thereon at least one silver halide emulsion layer, and a layer, which is the same or different from the silver halide layer, comprising crystalline solid particles consisting essentially of a disulfonamidophenol oxidized developer scavenger dispersed in an aqueous medium.

Another aspect of the present invention comprises a process for preparing a crystalline solid particle dispersion of a disulfonamidophenol oxidized developer scavenger, comprising the steps of:

(a) milling crystalline solid particles of the scavenger in an aqueous medium in the presence of a dispersing agent and in the substantial absence of an organic solvent to form a first dispersion; and (b) adding the first dispersion to an aqueous medium comprising a binder to form a second dispersion.

A further aspect of this invention comprises a process of preparing a photographic element which comprises the steps of:

(a) milling the crystalline solid of the scavenger in an aqueous medium in the presence of a dispersing agent and in the substantial absence of an organic solvent to form a first dispersion;

(b) adding the first dispersion to an aqueous medium comprising a binder to form a second dispersion; and (c) coating the second dispersion onto a support.

ADVANTAGEOUS EFFECT OF THE INVENTION

This invention provides a method of reducing undesired dye stain in a photographic element when a disulfonamidophenol oxidized developer scavenger is used. This is achieved by the use of the scavenger in the form of a crystalline solid particle dispersion.

As noted above, the prior art teaches that disulfonamidophenol oxidized developer scavengers are used as conventional oil-in-water dispersions, and their use in the form of crystalline solid particle dispersions has not, up to now, been described or suggested.

It was previously disclosed in U.S. Pat. No. 4,927,744 to Henzel et al that hydroquinone derivative oxidized developer scavengers incorporated in a photographic element in the form of conventional oil-in-water dispersions suffer from oxidative instability which is reduced if the hydroquinone is incorporated in the form of a crystalline solid particle dispersion. Disulfonamidophenol oxidized developer scavengers do not suffer from oxidative instability when dispersed as conventional oil-in-water dispersions.

DETAILED DESCRIPTION OF THE INVENTION

The disulfonamidophenol oxidized developer scavengers useful in the practice of the present invention are well known and can be prepared by synthesis techniques known in the art. Preferred disulfonamidophenol scavengers have the formula:

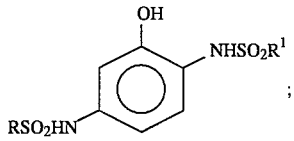

;

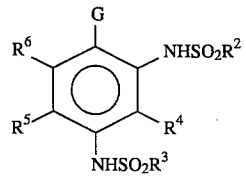

or

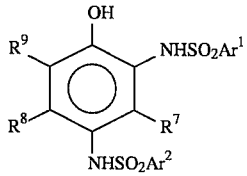

wherein:

R and $R^1$ represents a substituted or unsubstituted alkyl or aryl group;

G is hydroxy or an alkali labile precursor thereof;

each of $R^2$ and $R^3$ is individually alkyl of 1 to 30 carbon atoms, aryl of 6 to 30 carbon atoms or heterocyclic of 5 to 30 carbon atoms containing one or more ring hetero atoms; and each of $R^4$, $R^5$ and $R^6$ is individually hydrogen, halogen, alkyl of 1 to 30 carbon atoms, alkoxy of 1 to 30 carbon atoms or aryloxy of 6 to 30 carbon atoms;

each of $Ar^1$ and $Ar^2$ independently is an aryl group; and each of $R^7$, $R^8$, and $R^9$ independently is a monovalent group such as hydrogen, a halogen atom, an alkyl group, a cycloalkyl group, an aralkyl group, an aryl group, an alkenyl group, an alkynyl group, a heterocyclic group, an alkoxy group, an alkylthio group, or an acylamino group, each of which may have one or more substituent groups. A more detailed description of these compounds can be found U.S. Pat. Nos. 4,205,987 to Erikson et al, 4,447,523 to Ross et al and U.S. Pat. No. 4,952,474 to Tsukahara, the entire disclosures of which are hereby incorporated by reference.

Particularly preferred disulfonamidophenol scavengers are compounds of the formula:

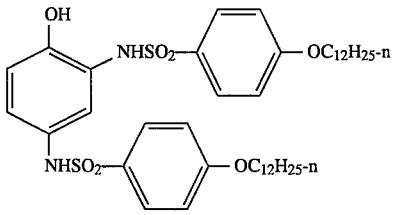

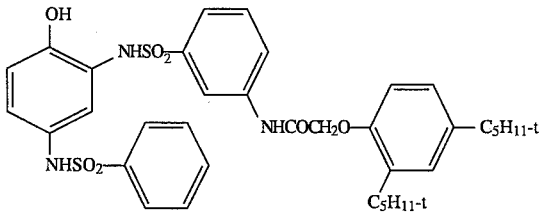

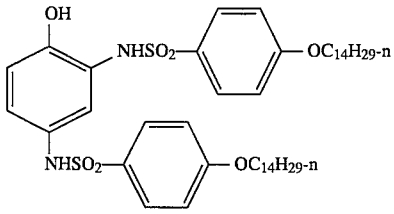

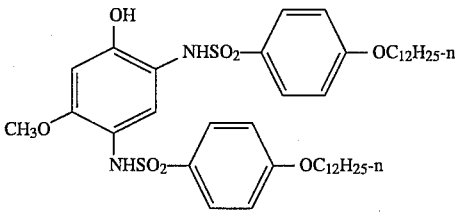

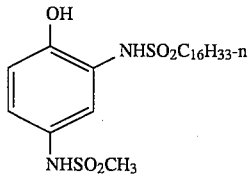

-continued

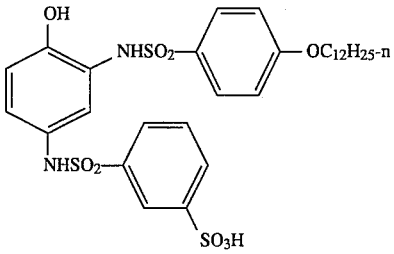

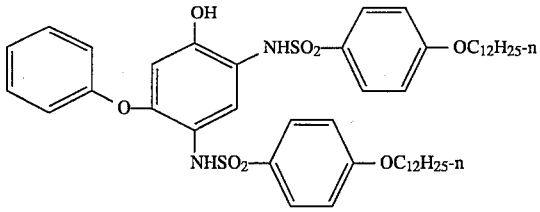

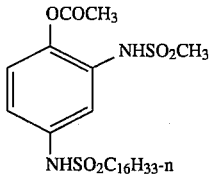

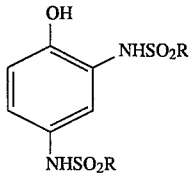

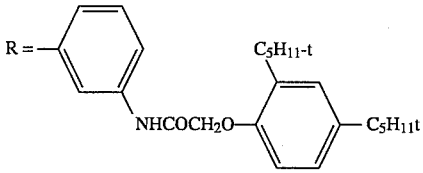

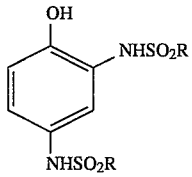

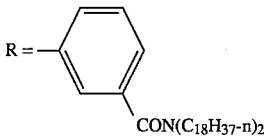

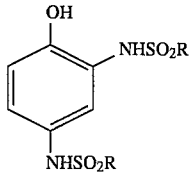

and

-continued

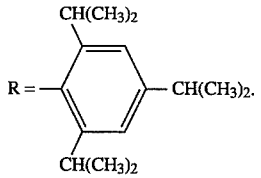

The scavenger compounds should be crystalline solids and substantially water insoluble at coating conditions, which generally involve temperatures from 10 C. to 50 C., and pH from 5.0 to 7.0. The crystalline solid particle dispersion can be formed by precipitating or reprecipitating the compound in the form of a dispersion in the presence of one or more dispersing agents, or by well known milling techniques. Reprecipitating techniques which involve dissolving the scavenger and precipitating by changing the solvent and/or pH in the presence of a dispersing agent are well known in the art. Reprecipitating techniques are described, for example, in U.S. application Ser. No. 07/812,503 by Texter, et al, filed Dec. 20, 1991, and are herein incorporated by reference. Milling techniques are also well known in the art, and examples include ball milling, media milling, attritor milling, jet milling or colloid milling the scavenger in the presence of a dispersing agent. The dispersing agent is preferably an anionic, nonionic or zwitterionic surfactant, or a water soluble homopolymer or copolymer. Mixtures of two or more dispersing agents can be used in the practice of this invention. The total amount of dispersing agent can vary over a wide range, generally from about 1% to about 200%, preferably about 5% to about 100%, the percentages being by weight, based on the weight of the scavenger.

Particularly preferred dispersing agents are an alkali metal salt of an alkarylene sulfonic acid, such as the sodium salt of dodecyl benzene sulfonic acid, the sodium salt of isopropylnaphthalene sulfonic acid or a mixture of monomers, dimers, trimers and tetramers of the sodium salt of isopropylnaphthalene sulfonic acid; an alkali metal salt of an alkyl sulfuric acid, such as sodium decyl sulfate or sodium dodecyl sulfate; or an alkali metal salt of an alkyl sulfosuccinate, such as sodium bis(2-ethylthexyl) succinic sulfonate, diethylpentyl sodium sulfosuccinate, dimethylpentyl sodium sulfosuccinate.

Examples of specifically preferred dispersing agents are:

If milling media is used to prepare the dispersion, the mill is charged with the media such as, for example, spheres of silica, sand, zirconium oxide, zirconium silicate, alumina, titania, glass, etc. The bead sizes typically range from 0.25 to 3.0 millimeters (mm) in diameter. The scavenger particles in the dispersion should have mean diameters from 0.01 to 10.0 micrometers (μm) and preferably from 0.05 to 5.0 micrometers (μm). The use of solid particle dispersions in imaging are described, for example in, U.S. Pat. No. 4,006,025 to Swank et al and U.S. Pat. No. 4,940,654 to Diehl et al, which are herein incorporated by reference. Milling techniques are described in for example, U.S. Pat. Nos. 3,008,657 to Szegvari, 3,075,710 to Feld et al and 3,149,789 to Szegvari.

The scavenger compounds can be used in the ways and for the purposes that scavengers for oxidized developing agent are employed in the art. They can be incorporated in a silver halide emulsion layer of the photographic element or in a separate layer of the element. When incorporated in a separate layer, that layer is preferably an interlayer between silver halide emulsion layers although it can be an undercoat layer coated below all of the silver halide emulsion layers or an overcoat layer coated above all of the silver halide emulsion layers. When the scavenger is in a layer between two silver halide layers, the two silver halide layers preferably comprise a coupler that can react with oxidized developer such as a color developer to form or release a photographically useful group. Such photographically useful groups are known in the art and may be groups such as dyes, development modifiers such as development inhibitors, and the like.

The amount of scavenger compound employed will depend upon the particular purpose for which the scavenger is to be used and the degree of scavenging desired. Typically useful results are obtained when the scavenger is employed in an amount of between about 5 and 1000 mg/sq. meter per layer.

The vehicle for the crystalline solid particle dispersion can be essentially any photographic vehicle, such as gelatin and other hydrophilic colloids, or various synthetic polymers such as polyvinyl alcohol or acrylamide polymers. Photographic vehicles commonly employed in silver halide photographic elements are described in *Research Disclosure*, December 1978, Item No. 17643, Section IX, the disclosure of which is incorporated herein by reference.

The photographic elements of the present invention can be simple black-and-white or monochrome elements comprising a support bearing a layer of the silver halide emulsion, or they can be multi-layer and/or multicolor elements. They can be designed for processing with separate solutions or for in-camera processing. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in any desired order. In an alternative format, the emulsion or emulsions can be disposed as one or more segmented layers, e.g., as by the use of microvessels or microcells, as described in U.S. Pat. No. 4,362,806 to Whitmore.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material, the element containing a scavenger of this invention. Preferably the scavenger is in an interlayer between silver halide emulsion layers sensitive to the same or different silver halide emulsion layers.

The elements of the present invention can contain additional layers conventional in photographic elements, such as overcoat layers, spacer layers, filter layers, antihalation layers, pH lowering layers (sometimes referred to as acid layers and neutralizing layers), timing layers, opaque reflecting layer, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, December 1978, Item 17643, referred to above. The support can be coated with a magnetic recording layer as discussed in *Research Disclosure* 34390 of November 1992, the disclosure of which is incorporated herein by reference.

The light-sensitive silver halide emulsions employed in the photographic elements of this invention can include coarse, regular or fine grain silver halide crystals or mixtures thereof and can be comprised of such silver halides as silver chloride, silver bromide, silver bromo-iodide, silver chlorobromide, silver chloroiodide, silver chlorobromoiodide, and mixtures thereof. The emulsions can be negative working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 7643, December 1978, and the references listed therein.

The photographic silver halide emulsions can contain other addenda conventional in the photographic art. Useful addenda are described, for example, in *Research Disclosure*, December 1978, Item 17643. Useful addenda include spectral sensitizing dyes and desensitizers, antifoggants, masking couplers, DIR couplers, DIR compounds, anti-stain agents, image dye stabilizers, absorbing materials, coating aids, plasticizers and lubricants, and the like.

Depending upon the dye image-providing material employed in the photographic element, it can be incorporated in the silver halide emulsion layer or in a separate layer associated with the emulsion layer. The dye image-providing material can be any of a number known in the art, such as dye-forming couplers, bleachable dyes, dye developers and redox dye-releasers, and the particular one employed will depend on the nature of the element and the type of image desired.

Dye image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Dye image-providing materials useful in diffusion transfer film units contain a dye moiety and a monitoring moiety. The monitoring moiety, in the presence of an alkaline processing solution and as a function of silver halide development, is responsible for a change in mobility of the dye moiety. These dye image-providing materials can be initially mobile and rendered immobile as a function of silver halide development, as described in U.S. Pat. No. 2,983,606. Alternatively, they can be initially immobile and rendered mobile, in the presence of an alkaline processing solution, as a function of silver halide development. This latter class of materials include redox dye-releasing compounds. In such compounds, the monitoring group is a carrier from which the dye is released as a direct function of silver halide development or as an inverse function of silver halide development. Compounds which release dye as a direct function of silver halide development are referred to as negative-working release compounds, while compounds which release dye as an inverse function of silver halide development are referred to as positive-working release compounds.

The developing agents that can be used to develop the photographic elements of this invention, the oxidized form of which can be reduced by the scavengers of this invention, include hydroquinones, aminophenols, 3-pyrazolidones and phenylene diamines. Some of these developing agents, when used for certain applications, are referred to in the art as electron transfer agents. The particular developing agent employed will depend on the particular type of photographic element to be processed. For example, phenylene diamines are the developers of choice for use with color photographic elements containing dye-forming couplers, while 3-pyrazolidones are preferably used with image transfer materials containing redox dye releasers.

Representative developing agents include: hydroquinone, N-methylaminophenol, 1-phenyl-3pyrazolidone, 1-phenyl-4,4-dimethyl-3-pyrazolidone, phenyl-4-methyl-4-hydroxymethyl-3-pyrazolidone, N,N-diethyl-p-phenylenediamine, 3-methyl-N,N-diethyl-p-phenylenediamine, 3-methoxy-N,N-diethyl-p-phenylenediamine, N,N,N',N'-tetramethyl-p-phenylenediamine.

The following examples illustrate the preparation and use of crystalline solid particle dispersions of oxidized developer scavengers in accordance with this invention and compare such dispersions to conventional oil-in-water dispersions of said scavengers. The specific scavengers used in the examples are of the formulae:

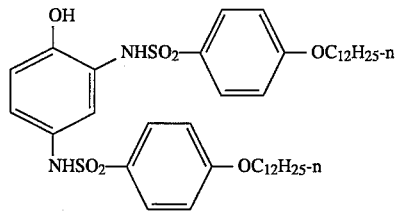

Cpd. 1 and

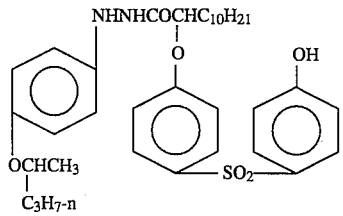

Cpd. 2

The dispersions used in the evaluation were prepared as follows:

Preparation A

A crystalline solid particle dispersion, Dispersion A, of a photographically useful disulfonamidophenol oxidized developer scavenger, Compound 1, was prepared by placing 120 g of Compound 1 in a 1-gallon glass jar containing 664 g distilled water, 16.0 g of a 75% aqueous solution of diethylhexyl sodium sulfosuccinate, commercially available as Aerosol OT from American Cyanamid, and 2000 ml of 1.8 mm zirconium oxide beads. The jar was rolled at a speed of 103 ft/min for 7 days. The milled slurry was mixed with gelatin and water to yield a dispersion containing 6% Compound 1 and 9% gelatin.

Preparation B

Dispersion B was prepared in the same manner as Dispersion A except it contained 8.0 g of a 75% aqueous solution of Aerosol OT, 60.0 g of a 10% aqueous solution of polyvinylpyrrolidone and 312.0 g distilled water.

Preparation C

A conventional oil-in-water dispersion, Dispersion C, of compound 1 was prepared by dissolving 12.0 g of compound 1 in 6.0 g of N, N-diethyl lauramide and 24.0 g of ethyl acetate at 60 C., then combining with an aqueous phase consisting of 16.0 g gelatin, 6.0 g of a 10% solution of a mixture of monomers, dimers, trimers and tetramers of the sodium salt of isopropylnaphthalene sulfonic acid, commercially available as Alkanol-XC from DuPont, and 136.0 g distilled water. The mixture was then passed through a colloid mill 5 times, followed by evaporation of the ethyl acetate using a rotary evaporator and replacement with distilled water to yield a dispersion having 6.0% compound 1 and 8.0% gelatin.

Preparation D

Dispersion D was prepared the same as Dispersion C except N, N-di-n-butyl lauramide was substituted for N, N-diethyl lauramide.

Preparation E

Dispersion E was prepared the same as Dispersion D except 12.0 g of N, N-di-n-butyl lauramide and 130.0 g of water were used.

Preparation F

Dispersion F was prepared the same as Dispersion C except 1, 4-cyclohexylenedimethylene bis(2-ethylhexanoate) was substituted for N, N-diethyl lauramide.

Preparation G

Dispersion G was prepared the same as Dispersion C except N, N-diethyl lauramide was omitted from the formulation, and 142.0 g of distilled water was used.

Preparation H

A conventional oil-in-water dispersion, Dispersion H, of a photographically useful hydrazide oxidized developer scavenger, Compound 2 was prepared by dissolving 12.0 g of Compound 2 in 12.0 g of di-n-butylphthalate and 24.0 g of ethyl acetate at 60 C., then combining with an aqueous phase consisting of 16.0 g gelatin, 6.0 g of a 10% solution of Alkanol-XC and 130.0 g distilled water. The mixture was then passed through a colloid mill 5 times, followed by evaporation of the ethyl acetate using a rotary evaporator and replacement with distilled water to yield a dispersion having 6.0% compound 2 and 8.0% gelatin.

Preparation I

Dispersion I was prepared the same as Dispersion H except 3.0 g N, N-diethyl lauramide was substituted for 12.0 g di-n-butylphthalate, and 139.0 g distilled water was used.

The oxidized developer dispersions were evaluated as set forth below in color negative photographic material prepared, exposed and processed according to conventional procedures. Multilayer films were prepared, each comprising three color records separated by one or more interlayers, each of which contains a dispersion of oxidized developer scavenger. The purpose of the interlayer is to prevent oxidized developer generated in one of the color layers from affecting any chemical reactions in another color layer.

The dye stain of concern is manifested by a spectral absorption at 640–660 nm. Therefore in evaluating the dispersions of this invention compared to conventional oil-in-water dispersions, the dispersions were incorporated into an interlayer positioned between green- and red-sensitive layers of a multilayer film structure. The multilayer film structure contained additional color sensitive layers and interlayers. The additional interlayers contained no oxidized developer scavenger, the oxidized developer scavenger being evaluated or a hydrazide oxidized developer scavenger (Cpd. 2) known to be non-staining at the relevant wavelength.

The following compounds were used in preparing the multilayer film structures set forth below.

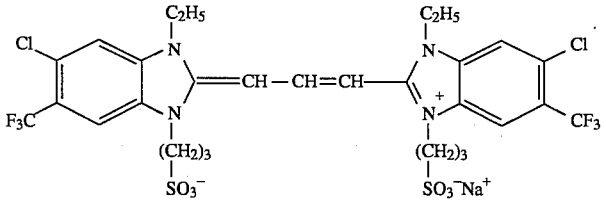

Cpd. 3

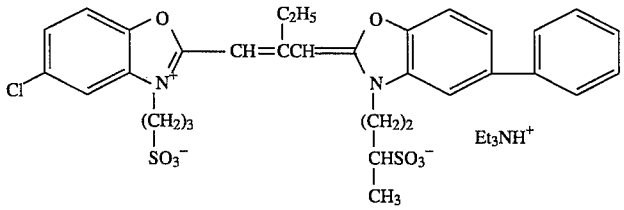

Cpd. 4

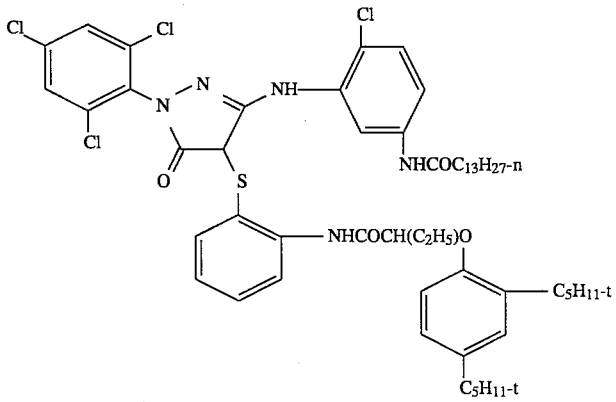

Cpd. 5

-continued
Cpd. 6
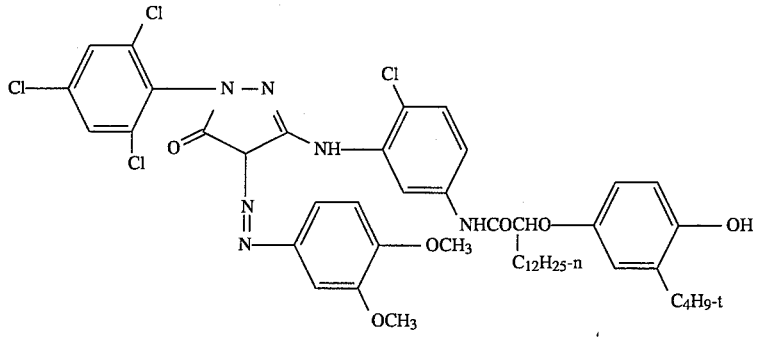
Cpd. 7
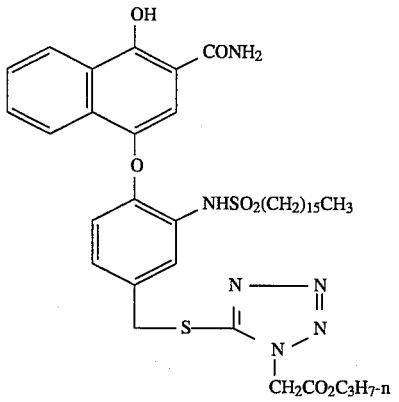
Cpd. 8
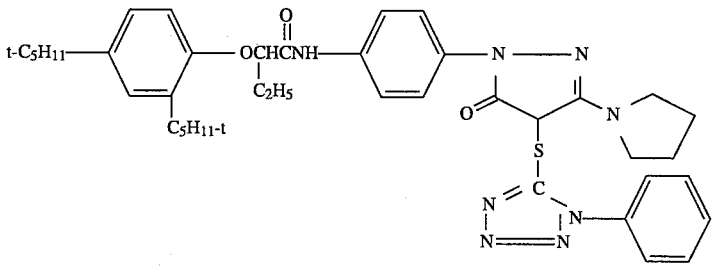
Cpd. 9
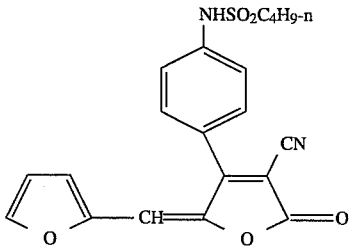
Cpd. 10
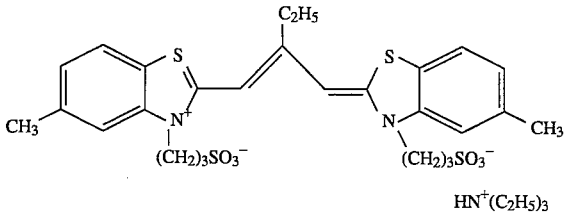
Cpd.11
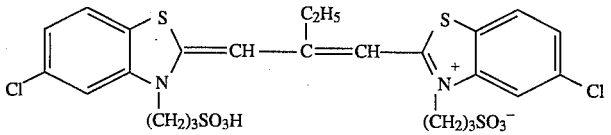

-continued

Cpd.12

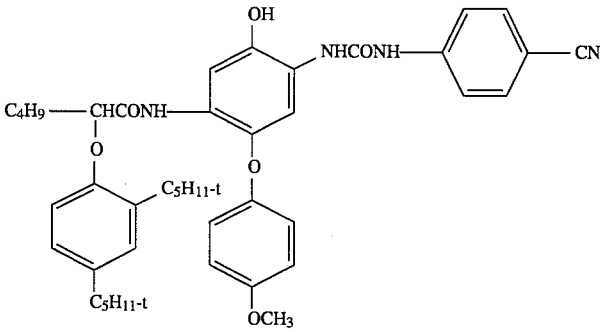

Cpd. 13

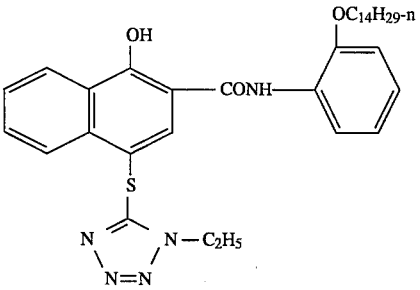

Cpd. 14

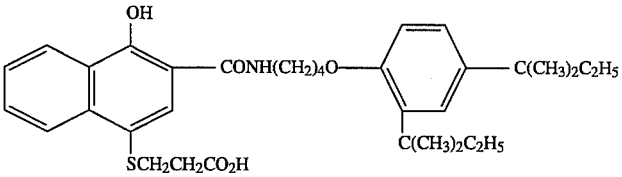

Cpd. 15

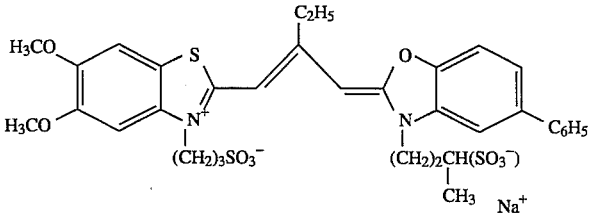

Cpd.16

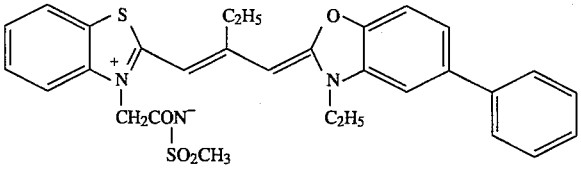

EXAMPLE 1

In this example, the oxidized developer scavenger Compound 1 dispersed as a crystalline solid particle dispersion, Dispersion A, is compared to a conventional oil-in-water dispersion of Compound 1, Dispersion C. In the multilayer film element of this example, red-and green-sensitive layers are separated by an interlayer that contains the above dispersions as designated below.

The photographic element used as a CONTROL in this example contained no oxidized developer scavenger and contained the following relevant layers and materials:

| FILM STRUCTURE I |
|---|
| GREEN SENSITIVE LAYER: |
| AgBrI tabular grain emulsion, 4.1% I, 2.25 × 0.126 μm, sensitized with cpds 3 & 4, 0.70 mmole/Ag mole, 0.6966 g/m$^2$. |
| AgBrI tabular grain emulsion, 4.1% I, 0.80 × 0.09 μm, sensitized with dye cpds 3 &4, 0.87 mmole/Ag mole, 0.64584 g/m$^2$. |
| magenta dye forming coupler, cpd 5,0.40903 g/m$^2$ |
| magenta dye forming coupler, cpd 6, 0.06781 g/m$^2$ |
| non color forming DIR coupler, cpd 7, 0.00861 g/m$^2$ |
| magenta dye forming coupler, cpd 8, 0.01067 g/m$^2$ |
| gelatin, 1.4316 g/m$^2$ |
| INTERLAYER |

-continued

FILM STRUCTURE I yellow filter dye, cpd 9, 0.04306 g/m$^2$
gelatin, 1.29168 g/m$^2$
RED SENSITIVE LAYER AgBrI tabular grain emulsion, 4.1% I,
3.50 × 0.127 μm,sensitized with cpds 10 & 11,
0.86 mmole/Ag mole, 1.3670 g/m$^2$
cyan dye forming coupler, cpd 12, 0.25834 g/m$^2$
cyan dye forming DIR coupler, cpd 13, 0.4629 g/m$^2$
cyan dye forming coupler, cpd 14, 0.00269 g/m$^2$
gelatin, 1.8514 g/m$^2$ A COMPARISON film structure was prepared in the same manner as the CONTROL except that the interlayer contained 0.9688 g/square meter gelatin and 0.0431 g/square meter Compound 1 incorporated as Dispersion C, a conventional oil-in-water dispersion.

A film of the INVENTION was prepared in the same manner as the control except that the interlayer contains 0.9688 g/square meter gelatin and 0.0431 g/square meter Compound 1 incorporated as Dispersion A, a crystalline solid particle dispersion.

The photographic film elements prepared as above were tested for 645 nm dye aggregate as follows:

The presence (1) of the staining species can be estimated qualitatively by visual examination of the spectrum of a film sample. Quantifying the amount of 645 nm peak is done by the following differencing procedure. The spectral density of the film element at 645 nm is recorded. The film element is then treated in a persulfate bath to remove the staining species. The 645 nm spectral density of the film element is again recorded, and the difference (2) between the two values is calculated.

The results are reported in Table I and demonstrate that the dye stain present with the conventional oil-in-water dispersion, Dispersion C, is not present with the crystalline solid particle dispersion of this invention, Dispersion A.

TABLE I

| Sample | Oxidized Developer Scavenger | 645 nm Density Presence (1) | 645 nm Density Difference (2) |
|---|---|---|---|
| Control | None | No | 0.010 |
| Comparison | Dispersion C[a] | Yes | 0.114 |
| Invention | Dispersion A[b] | No | 0.010 |

[a]Other interlayers present in the multilayer film element contained Dispersion C or no oxidized developer scavenger.
[b]Other interlayers present in the multilayer film element contained Dispersion A or a non-staining hydrazide scavenger which does not affect the results of the evaluation.

The photographic film elements were tested for the ability of the interlayer formulation to prevent color contamination as follows:

The scavenging ability of each interlayer formulation may be determined by the following method. The multilayer containing interlayers formulated with the control, comparison or invention dispersions was exposed to red or green light only. The exposed color record is the only layer that developed and was designated the "causer" layer. Any other color records, which did not develop were designated "receiver" layers. The only way for color density to change in a receiver layer is for oxidized developer from the causer layer to diffuse through the interlayer to the receiver layer. Differences in the density in a receiver layer indicate differences in the effectiveness of the dispersion formulations in reacting with oxidized developer and preventing color contamination.

The results are reported in Table Ia, below, and demonstrate that the use of an interlayer containing a crystalline solid particle dispersion of the oxidized developer scavenger in accordance with this invention is equally or more effective than the CONTROL or COMPARISON.

TABLE Ia

| Sample | Oxidized Developer Scavenger | Red Causer Green Receiver | Green Causer Red Receiver |
|---|---|---|---|
| Control | None | 0.24 | 0.44 |
| Comparison | Dispersion C | 0.22 | 0.41 |
| Invention | Dispersion A | 0.20 | 0.41 |

EXAMPLE 2

In this example, the oxidized developer scavenger Compound 1 dispersed as crystalline solid particle dispersions, Dispersion A and Dispersion B, are compared to the conventional oil-in-water dispersion of Compound 1, Dispersion C. In the multilayer film element of this example, red- and green-sensitive layers are separated by an interlayer that contains the dispersions as described below.

The photographic element used as a control in this example contains the following relevant layers and materials:

FILM STRUCTURE II

GREEN SENSITIVE LAYER:

AgBrI tabular grain emulsion, 4.1%I,
2.25 × 0.126 μm, sensitized with cpds 3 & 4,
0.70 mmole/Ag mole, 0.6966 g/m$^2$
AgBrI tabular grain emulsion, 4.1% I, 0.80 × 0.09 μm,
sensitized with dye cpds 3 & 4
0.87 mmole/Ag mole, 0.6458 g/m$^2$
magenta dye forming coupler, cpd 5, 0.4090 g/m$^2$
magenta dye forming coupler, cpd 6, 0.0678 g/m$^2$
non color forming DIR coupler, cpd 7, 0.0086 g/m$^2$
magenta dye forming coupler, cpd 8, 0.0107 g/m$^2$
gelatin, 1.4316 g/m$^2$
INTERLAYER:

oxidized developer scavenger (DISPERSION H),
0.0861 g/m$^2$
gelatin, 0.9688 g/m$^2$
RED SENSITIVE LAYER:

AgBrI tabular grain emulsion, 4.1% I,
3.50 × 0.127 μm, sensitized with cpds 11 & 15,
0.85 mmole/Ag mole, 1.3670 g/m$^2$
cyan dye forming coupler, cpd 12 0.2799 g/m$^2$
cyan dye forming DIR coupler, cpd 13, 0.0463 g/m$^2$
gelatin, 1.8514 g/m$^2$ The above film structure includes an interlayer which contains a non-staining hydrazide scavenger and is the CONTROL.

A COMPARISON film structure was prepared in the same manner as the CONTROL except that in the interlayer, Dispersion H containing Compound 2, was replaced with 0.0431 g/square meter Compound 1 incorporated as a conventional oil-in-water dispersion, Dispersion C.

A multilayer film of the invention, INVENTION 2-1, was prepared in the same manner as the CONTROL except that in the interlayer, Dispersion H containing Compound 2, was replaced with 0.0431 g/square meter Compound 1 incorporated as Dispersion A, a crystalline solid particle dispersion in accordance with this invention.

A second multilayer film of the invention, INVENTION 2-2 was prepared in the same manner as the CONTROL except that in the interlayer, Dispersion H containing Compound 2 was replaced with 0.0431 g/square meter Compound 1 incorporated as Dispersion B, a crystalline solid particle dispersion in accordance with this invention.

The multilayer films prepared above were tested for 645 nm dye aggregate as set forth in Example 1 above. As reported in Table II, the crystalline solid particle dispersions of INVENTION 2-1 and INVENTION 2-2 retain less stain than the COMPARISON so that their performance is equal to or better than the nonstaining CONTROL and better than the COMPARISON.

TABLE II

| Sample | Oxidized Developer Scavenger | 645 nm Density Presence (1) | Difference (2) |
|---|---|---|---|
| Control | Dispersion H[a] | No | 0.011 |
| Comparison | Dispersion C[a] | Yes | 0.042 |
| Invention 2-1 | Dispersion A[a] | No | 0.009 |
| Invention 2-2 | Dispersion B | No | 0.007 |

[a]Other interlayers present in the multilayer film element contained a nonstaining hydrazide scavenger which does not affect the results of the evaluation. These interlayers were not varied in Example 2.

EXAMPLE 3

In this example, the oxidized developer scavenger Compound 1 dispersed as a crystalline solid particle dispersion, Dispersion B, is compared to conventional oil-in-water dispersions of Compound 1, as Dispersion F, Dispersion G, Dispersion E and Dispersion D. In the multilayer film element of this example, red- and green-sensitive layers are separated by an interlayer that contains the dispersions as described below. The photographic element used as COMPARISON 3-1 in this example contains the following layers and materials:

FILM STRUCTURE III

GREEN SENSITIVE LAYER:

AgBrI tabular grain emulsion, 4.1% I,
2.25 × 0.126 μm, sensitized with cpds 3 & 4
0.84 mole/Ag mole, 0.6966 g/m$^2$
AgBrI tabular grain emulsion, 4.1%I,
0.80 × 0.09 μm, sensitized with cpds 3 & 4,
0.87 mmole/Ag mole, 0.6458 g/m$^2$
magenta dye forming coupler, cpd 5, 0.3767 g/m$^2$
magenta dye forming coupler, cpd 6, 0.0678 g/m$^2$
non color forming DIR coupler, cpd 7, 0.0043 g/m$^2$
magenta dye forming coupler, cpd 8, 0.0054 g/m$^2$
gelatin, 1.4316 g/m$^2$
INTERLAYER:

-continued

FILM STRUCTURE III oxidized developer scavenger (DISPERSION F),
0.0431 g/m$^2$
gelatin, 0.9688 g/m$^2$
RED SENSITIVE LAYER:

AgBrI tabular grain emulsion, 3.4% I,
3.60 × 0.107 μm, sensitized with cpds 11 & 15,
0.82 mmole/Ag mole, 1.3670 g/m$^2$
cyan dye forming coupler, cpd 12, 0.2799 g/m$^2$
cyan dye forming DIR coupler, cpd 13, 0.0463 g/m$^2$
gelatin, 1.8514 g/m$^2$ A second multilayer comparative film COMPARISON 3-2 was prepared in the same manner as COMPARISON 3-1, except that in the interlayer, the conventional oil-in-water dispersion of Compound 1, Dispersion F, is replaced with 0.0431 g/square meter Compound 1 incorporated as a conventional oil-in-water dispersion, Dispersion G.

A third multilayer comparative film, COMPARISON 3-3 was prepared in the same manner as COMPARISON 3-1, except that in the interlayer, the conventional oil-in-water dispersion of Compound 1 Dispersion F is replaced with 0.0431 g/square meter Compound 1 incorporated as a conventional oil-in-water dispersion, Dispersion E.

A fourth multilayer comparative film, COMPARISON 3-4 was prepared in the same manner as COMPARISON 3-1 except that in the interlayer, the conventional oil-in-water dispersion of Compound 1 Dispersion F is replaced with 0.0431 g/square meter Compound 1 incorporated as a conventional oil-in-water dispersion, Dispersion D.

A multilayer film of this invention, INVENTION was prepared in the same manner as COMPARISON 3-1 except that in the interlayer, the conventional oil-in-water dispersion of Compound 1, Dispersion F, is replaced with 0.0431 g/square meter Compound 1 incorporated as a crystalline solid particle dispersion in accordance with this invention Dispersion B.

The multilayer films prepared as set forth above were tested for 645 nm dye aggregate as set forth in Example 1 above. Table III shows that Compound 1 dispersed as a crystalline solid particle Dispersion B exhibits less stain than the conventional oil-in water dispersions of Compound 1.

TABLE III

| Sample | Oxidized Developer Scavenger | 645 nm Density Presence (1) | Difference (2) |
|---|---|---|---|
| Comparison 3-1 | Dispersion F[a,b] | Yes | 0.068 |
| Comparison 3-2 | Dispersion G[a,c] | Yes | 0.062 |
| Comparison 3-3 | Dispersion E[a,d] | Yes | 0.028 |
| Comparison 3-4 | Dispersion D[a,e] | Yes | 0.023 |
| Invention | Dispersion B[a,f] | No | 0.011 |

[a]One other interlayer in the multilayer film element contained Dispersion I. This interlayer did not vary within Example 3.
[b]Two other interlayers in the multilayer film element contained Dispersion F.
[c]Two other interlayers in the multilayer film element contained Dispersion G.
[d]Two other interlayers in the multilayer film element contained Dispersion E.
[e]Two other interlayers in the multilayer film element contained Dispersion D.
[f]Two other interlayers in the multilayer film element contained Dispersion B.

The multilayer films prepared above were tested for the ability to prevent color contamination as set forth in Example 1 above. The results are reported in Table IIIa and demonstrate that Dispersion B, a crystalline solid particle dispersion of Compound 1 in accordance with this invention is equally effective as the conventional oil-in-water dispersions, Dispersions F, G, D and E.

TABLE IIIa

| Sample | Oxidized Developer Scavenger | Red Causer Green Receiver | Green Causer Red Receiver |
|---|---|---|---|
| Comparison 3-1 | Dispersion F | 0.18 | 0.310 |
| Comparison 3-2 | Dispersion G | 0.18 | 0.300 |
| Comparison 3-3 | Dispersion E | 0.18 | 0.310 |
| Comparison 3-4 | Dispersion D | 0.19 | 0.350 |
| Invention | Dispersion B | 0.18 | 0.340 |

The invention has been described in detail with particular reference to preferred embodiments thereof, but it is to be understood that variations and modifications can be effected within the spirit and scope of the invention.

What is claimed is:

1. A photographic element comprising a support having thereon at least one silver halide emulsion layer, and a layer, which is the same or different from the silver halide layer, comprising disulfonamidophenol oxidized developer scavenger dispersed in an aqueous medium, wherein the dispersed disulfonamidophenol oxidized developer scavenger consists essentially of disulfonamidophenols in solid particle crystalline form.

2. A photographic element according to claim 1, wherein the disulfonamidophenol has the formula TABLE IIIa

| Oxidized Developer | Red Causer Green | Green Causer |
|---|---|---|

wherein: R and $R^1$ represents a substituted or unsubstituted alkyl or aryl group; G is hydroxy or an alkali labile precursor thereof; each of $R^2$ and $R^3$ is individually alkyl of 1 to 30 carbon atoms, aryl of 6 to 30 carbon atoms or heterocyclic of 5 to 30 carbon atoms containing one or more ring hetero atoms; and each of $R^4$, $R^5$ and $R^6$ is individually hydrogen, halogen, alkyl of 1 to 30 carbon atoms, alkoxy of 1 to 30 carbon atoms or aryloxy of 6 to 30 carbon atoms; each of $Ar^1$ and $Ar^2$ independently is an aryl group; and each of $R^7$, $R^8$, and $R^9$ independently is a hydrogen or halogen atom, or an unsubstituted or substituted alkyl, cycloalkyl aralkyl, aryl, alkenyl, alkynyl, heterocyclic, alkoxy, alkylthio, or acylamino group.

3. A photographic element of claim 2, wherein the disulfonamidophenol has the formula: [0001]

4. A photographic element according to claim 1, wherein the dispersed disulfonamidophenol oxidized developer scavenger is formed by a process comprising the steps of: (a) milling crystalline solid particles of the scavenger in an aqueous medium in the presence of a dispersing agent and in the substantial absence of an organic solvent to form a first dispersion; and (b) adding the first dispersion to an aqueous medium comprising a binder to form a second dispersion.

5. A photographic element according to claim 4, wherein the dispersing agent is an anionic, nonionic or zwitterionic surfactant, a water soluble homopolymer or copolymer, or mixtures thereof.

6. A photographic element according to claim 1, prepared by a process which comprises the steps of: (a) milling crystalline solid particles of a disulfonamidophenol oxidized developer scavenger in an aqueous medium in the presence of a dispersing agent and in the substantial absence of an organic solvent to form a first dispersion; (b) adding the first dispersion to an aqueous medium comprising a binder to form a second dispersion; and (c) coating the second dispersion onto a support.

* * * * *

IN THE UNITED STATES PATENT AND TRADEMARK OFFICE

CERTIFICATE OF CORRECTION

PATENT NO.: 5,455,155 
DATED: October 3, 1995
INVENTOR(S): Mary C. Brick, et al It is certified that an error appears in the above-identified patent and that said Letters Patent is hereby corrected as shown below:

Title page, Section [62], delete "Division" and insert therefor --Continuation In Part--.

Column 5, after line 46, insert the following structures DA1 through DA31:

--DA-1

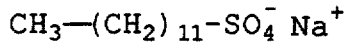

DA-2

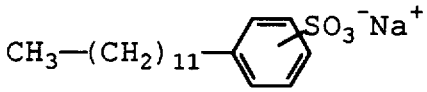

DA-3

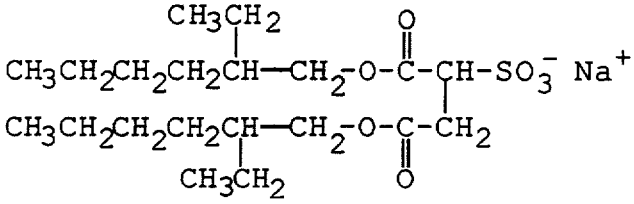

DA-4

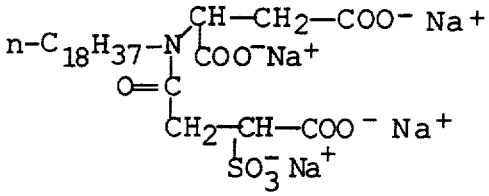

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below (continuation from previous page of correction to Column 5):

DA-5

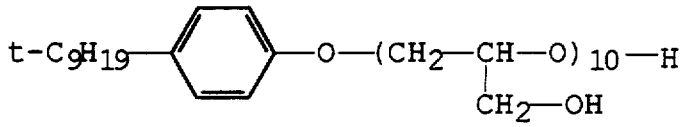

DA-6

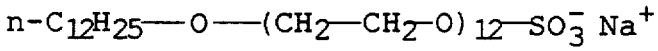

DA-7

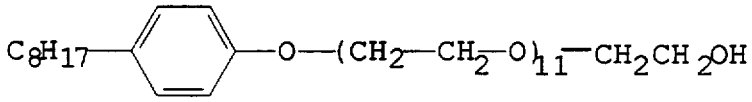

DA-8

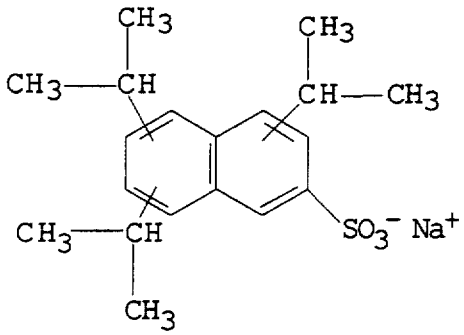

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below (continuation from previous page of correction to Column 5):

DA-9

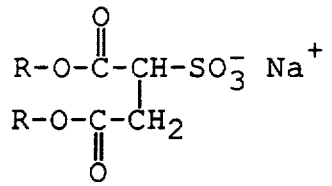

where R = $-CH(CH_3)C_4H_9$

DA-10 where R= $-CH_2-CH_2-$ 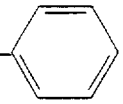

DA-11

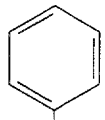

where R= $-CH_2-CH-CH_3$

DA-12 where R= $-CH_2-CH(CH_2CH_3)C_3H_7$

DA-13 where R= $-(CH_2)_nCH_3$ (n=2,3&5)

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below (continuation from previous page of correction to Column 5):

DA-14

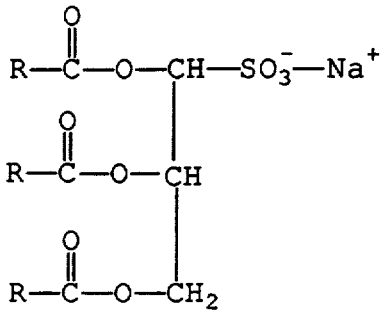

where R=—$(CH_2)_n$— 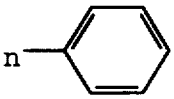 (n=2-5)

DA-15

$$n\text{-}C_{12}H_{25}—O—(CH_2—CH_2—O)_{22}—CH_2CH_2OH$$

DA-16

$$C_{12}H_{25}—O—(CH_2—CH_2—O)_{15}—CH_2$$
$$CH_2—SO_3^-Na^+$$

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below (continuation from previous page of correction to Column 5):

DA-17

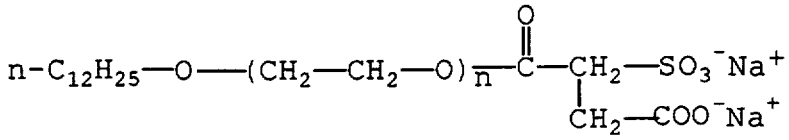

n=3-5

DA-18

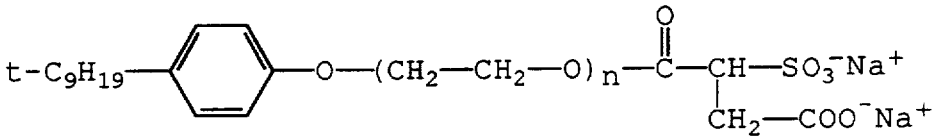

n=5-10

DA-19

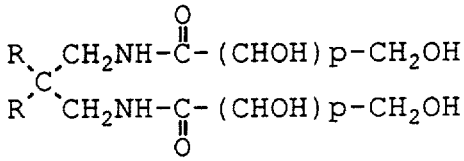

where p = 3 to 10 where, R = n-$CH_3$—$(CH_2)_x$—(where x = 3-10)

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below (continuation from previous page of correction to Column 5):

DA-20 where R= 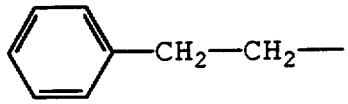

DA-21

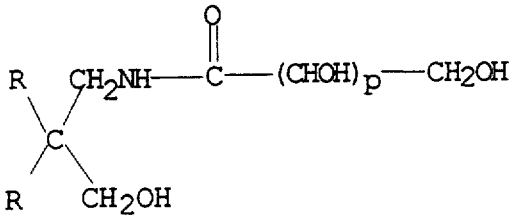

where, R=n-$CH_3$—$(CH_2)_x$— (where x=3 to 10 p=3 to 15)

DA-22 R= 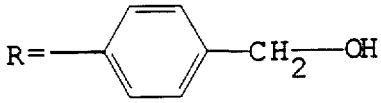

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below (continuation from previous page of correction to Column 5):

DA-23

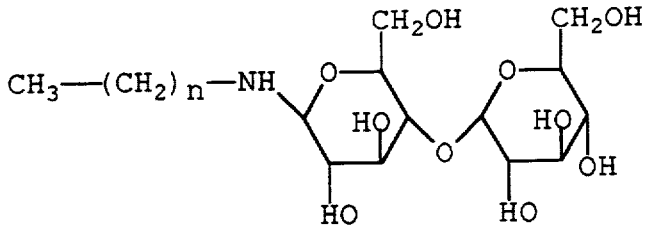

where, n = 3 to 15

DA-24

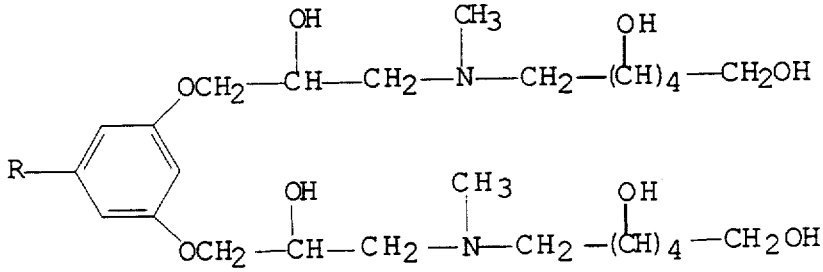

where $R=CH_3-(CH_2)_x$
(where, x = 1 to 5)

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below (continuation from previous page of correction to Column 5):

DA-25

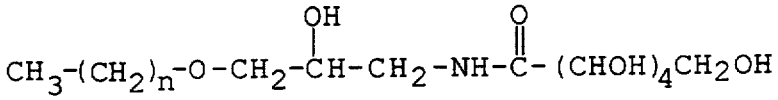

where n = 3 to 15

DA-26

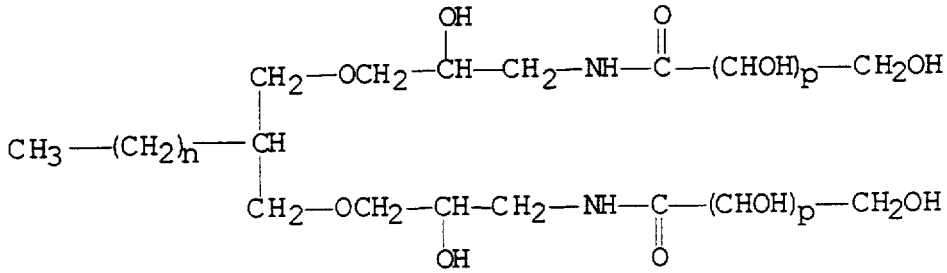

where, n =2 to 12
p=3 to 10

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below (continuation from previous page of correction to Column 5):

DA-27

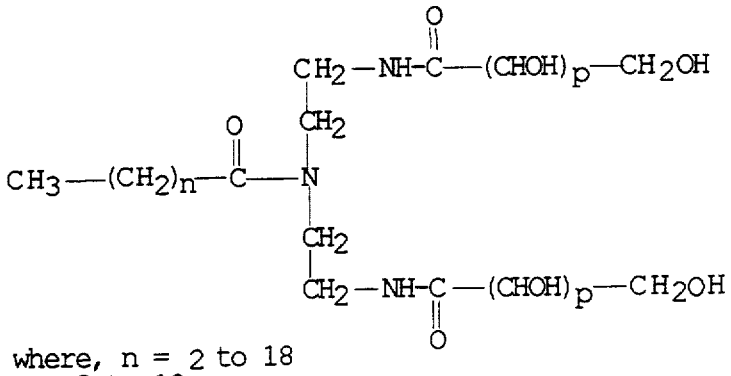

where, n = 2 to 18
p = 3 to 10

DA-28

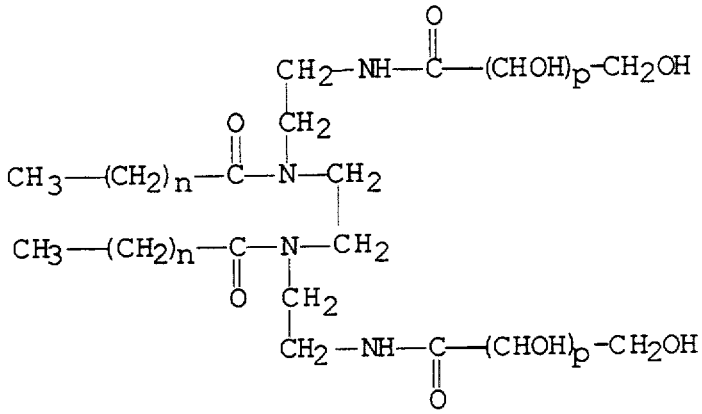

where, n = 2 to 18
p = 3 to 10

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below (continuation from previous page of correction to Column 5):

DA-29

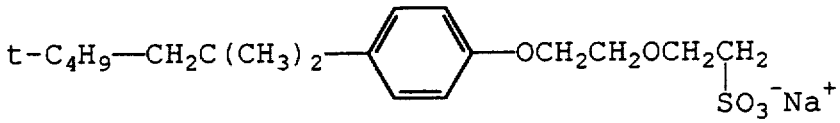

DA-30

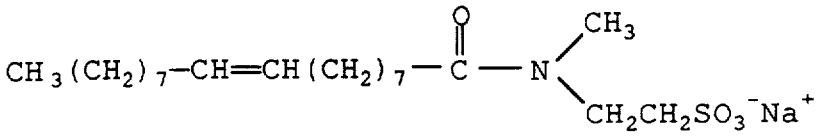

DA-31

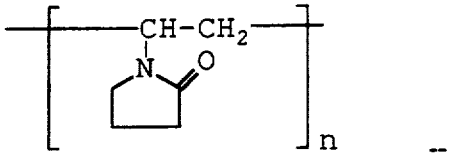

polyvinylpyrrolidone

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below:

Column 18, line 57, change "Dispersion $D^{a,c}$" to --Dispersion $D^{a,e}$--.
Column 18, line 64, change "$^{c}$Two" to --$^{e}$Two--.
Column 19, line 38, insert the following structures:

--

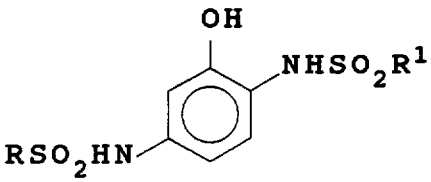

;

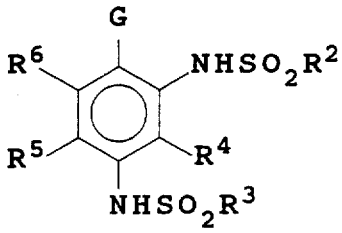

OR

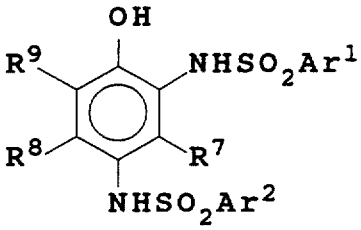

--

Column 20, please delete lines 1-5.

IN THE UNITED STATES PATENT AND TRADEMARK OFFICE

CERTIFICATE OF CORRECTION

PATENT NO.: 5,455,155
DATED: October 3, 1995
INVENTOR(S): Mary C. Brick, et al It is certified that an error appears in the above-identified patent and that said Letters Patent is hereby corrected as shown below:

Column 20, line 15, delete "[0001]", and insert the following structure therefor:

--

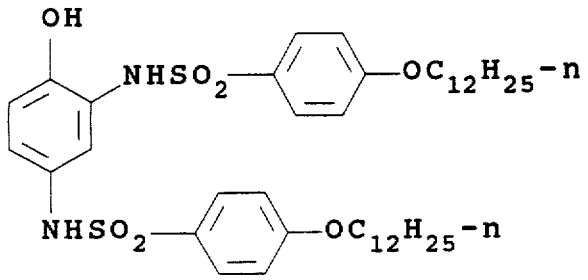

--

Signed and Sealed this

Fourth Day of June, 1996

*Attest:*

*Attesting Officer*

BRUCE LEHMAN

*Commissioner of Patents and Trademarks*